United States Patent [19]

Meyers

[11] 4,326,634

[45] Apr. 27, 1982

[54] SIDE LOADING, TOP OPENING, RECLOSABLE CARTON

[75] Inventor: George L. Meyers, Ashland, Ohio

[73] Assignee: American Can Company, Greenwich, Conn.

[21] Appl. No.: 190,931

[22] Filed: Sep. 26, 1980

[51] Int. Cl.[3] ..... B65D 5/26; B65D 5/54

[52] U.S. Cl. ..... 206/626; 229/36; 229/DIG. 11

[58] Field of Search ..... 206/626, 624; 229/35, 229/36, DIG. 11, 33

[56] References Cited

U.S. PATENT DOCUMENTS

| | | | |
|---|---|---|---|
| Re. 26,185 | 4/1967 | Henry | 206/626 |
| 1,667,975 | 5/1928 | Labombarde | 229/33 |
| 2,419,391 | 4/1947 | Crary | 229/35 |
| 2,605,955 | 8/1952 | Meller | 229/35 |
| 3,265,285 | 8/1966 | Fanter | 206/626 |
| 4,269,347 | 5/1981 | Cavan, Jr. | 229/33 |

FOREIGN PATENT DOCUMENTS

| | | | |
|---|---|---|---|
| 1290353 | 4/1902 | France | 229/33 |

*Primary Examiner*—Stephen P. Garbe

*Attorney, Agent, or Firm*—Robert P. Auber; Stuart S. Bowie; Thomas D. Wilhelm

[57] ABSTRACT

A side loading, top opening reclosable carton, formed from a one piece blank has multiple layer front, rear and side walls, and single layer top and bottom walls, providing efficient placement of multiple layers of material only in the vertical walls, which are subjected to substantial stacking stresses. An optional, and novel, end lock has a male lock tab on a front side flap confined between embossments on two rear side flaps. The lock is secured by adhesion provided by a bottom side flap and bridging the front side flap and the outer rear side flap.

9 Claims, 9 Drawing Figures

SIDE LOADING, TOP OPENING, RECLOSABLE CARTON

BACKGROUND OF THE INVENTION

This invention pertains to crush-resistant cartons. Such cartons are typically used in the packaging of heavy articles which may be stacked or otherwise roughly handled. When a group of packages is handled together, as is common in shipping and handling, the weight of overlying packages may exert large downward forces on the carton front, rear, and side walls. Similarly, the combined mass of the group of packages exerts substantial inertial forces on the package walls as a result of shocks such as are experienced in loading and unloading of trucks.

Thus reinforcement of certain walls of the package may be highly desirable. However, increasing the package material thickness overall may cause the use of more materials than necessary on some package walls. For example, in the packaging of fruit cake, the heavy product provides a modest, but adequate, degree of support to the top and bottom walls of the carton. The front, rear, and side walls, however, require reinforcement. Thus, an overall increase in material thickness would result in excessive material use in the top and bottom walls. While certain existing cartons have reinforced walls, known cartons are deficient in one or more areas of package function.

Patents believed material to the examination of this application are United States Patents:

Re. 15,453
149,139
622,495
622,496
1,869,742
3,014,633
3,503,550
3,543,994
3,638,850

SUMMARY OF THE INVENTION

In brief, the invention is a novel side loading top-opening carton having reinforced stacking strength in its front, rear and side walls, and formed from a one-piece blank, the carton comprising opposing front and rear walls, and left and right side walls, a bottom wall hingedly attached to the front and rear walls, and a top wall hingedly attached to the rear wall. The front wall comprises an inner front wall panel, and an outer skirt connected to the front edge of the top wall. The outer skirt comprises an outer skirt panel having the connection to the top wall, and projecting downwardly substantially the entire height of the carton, from top to bottom thereof, and an inner skirt panel connected to the bottom of the outer skirt panel at a predetermined fold line, and to the top of the inner front wall panel. The inner skirt panel is disposed between, and facing, both the outer skirt panel and the inner front wall panel. The front wall has a line of weakness extending from one said side edge to the other said side edge. The inner and outer front skirt panels are affixed to each other between the line of weakness and the predetermined fold line. The rear wall comprises a first panel hingedly attached to the top wall and extending downwardly substantially the entire height of the rear wall, and a second panel hingedly attached to the bottom wall and extending upwardly substantially the entire height of the rear wall.

The carton may further have novel side locks wherein each side wall has a front side flap connected to, and projecting rearwardly from, the front wall, and a male locking tab projecting rearwardly from its rear edge. Each side wall also has a pair of inner and outer rear side flaps connected to, and projecting frontwardly from, the rear wall, the rear side flaps being secured to each other in face to face relationship. The inner rear side flap has a first front edge substantially coincident with the rear edge of the corresponding front side flap, and has a pair of shoulders projecting frontwardly from its front edge on its top and bottom. The rear inner side flap has an inward embossment extending rearwardly from the front edge and corresponding in shape with, and underlying, the male locking tab, and has a cut line extending rearwardly from the front edge of the flap across the embossment. The outer rear side flap has a second front edge located frontwardly of the first front edge. Each side wall also has a bottom securing flap hingedly attached to the corresponding side edge of the bottom wall, the bottom securing flaps overlying, and being secured to, corresponding ones of both the outer rear side flaps and the front side flaps. The outer rear side flap may have an outer embossment corresponding in shape to, and overlying, the male locking tab.

DESCRIPTION OF THE ILLUSTRATED EMBODIMENT

Figure 1:
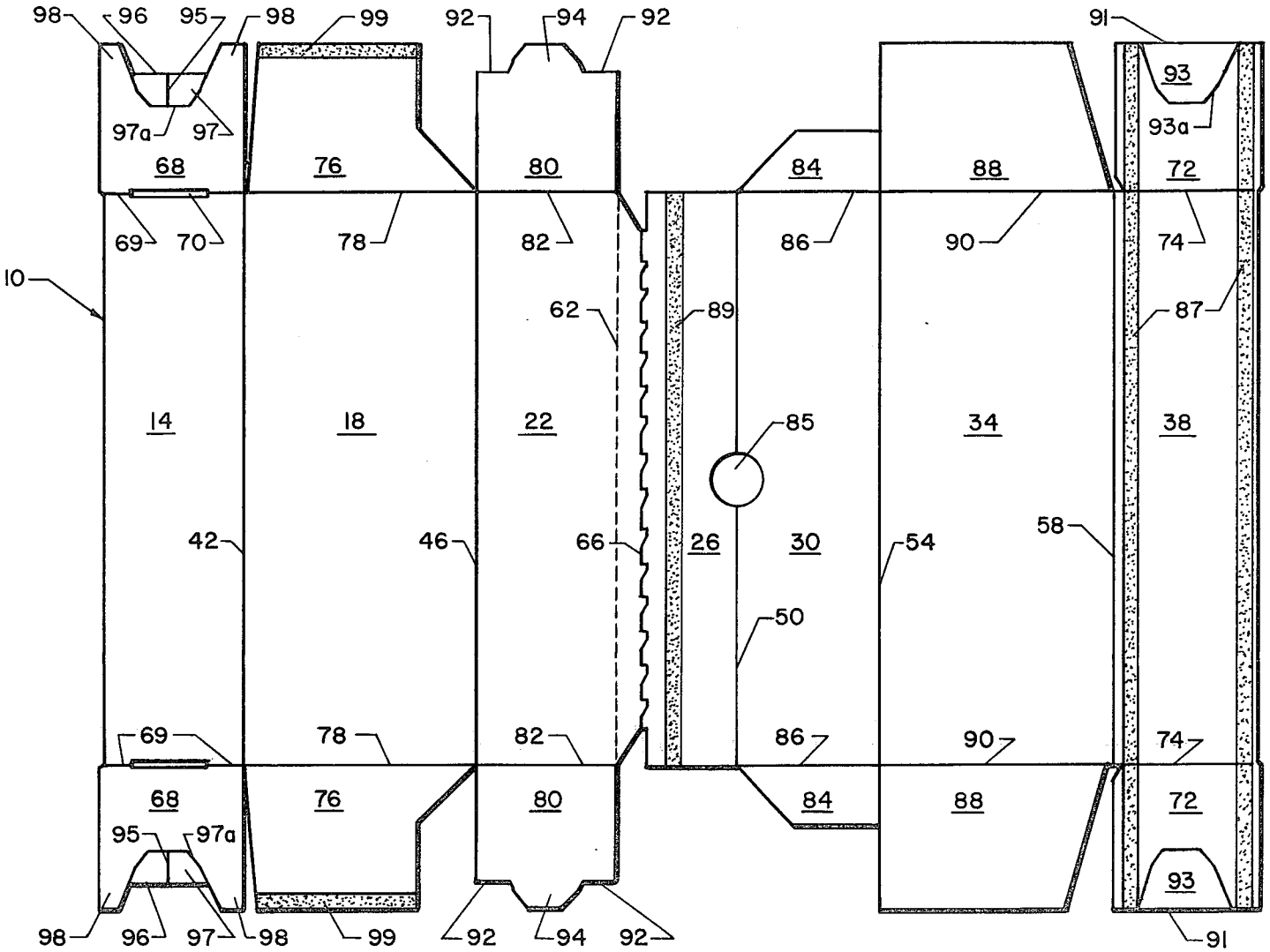
FIG. 1 is a plan view of a blank of the carton of this invention.

Turning now to FIG. 1, the carton blank is designated generally as 10. Beginning at the left edge of FIG. 1, the main body panels of the carton blank are outer rear panel 14, bottom wall panel 18, inner front wall panel 22, inner skirt panel 26, outer skirt panel 30, top wall panel 34 and inner rear panel 38. Panels 14 and 18 are joined by creased score line 42. Panels 18 and 22 are joined by score line 46. Panels 26 and 30 are joined by score line 50. Panels 30 and 34 are joined by score line 54. Panels 34 and 38 are joined by score line 58. Panels 22 and 26 are joined by dashed cut line 62. A line of weakness 66 extends across panel 26 as shown.

Inner rear side flaps 68 are connected to panel 14 by hinge lines 69. Each hinge line 69 is interrupted along its length by a narrow, elongated hole 70. Outer rear side flaps 72 are connected to panel 38 by hinge lines 74. Bottom side flaps 76 are connected to bottom wall 18 by hinge lines 78. Front side flaps 80 are connected to inner front wall panel 22 by hinge lines 82. Skirt connecting tabs 84 are connected to outer skirt panel 30 by hinge lines 86. Side skirt flaps 88 are connected to top wall panel 34 by hinge lines 90.

Each front side flap 80 has a rear edge 92 and a male lock tab 94 projecting outwardly beyond edge 92.

Inner rear flaps 68 have a front edge 96, and shoulders 98 projecting outwardly beyond front edge 96. Embossments 97 are defined by lines 97*a* and front edge 96, and extend from front edge 96 toward panel 14, assuming a generally planar shape similar in shape to, and, in the flat blank, opposite in direction from, male tab 94. Cut lines 95 extend across embossments 97 from the front edge 96 to lines 97*a*.

Outer rear side flaps 72 have embossments 93 defined by lines 93*a* and front edge 91, the embossments extending from front edge 91 toward panel 38. The inner edges 93*a* of embossments 93 are generally similar in shape to, and in the flat blank, opposite in direction from, the outer edges of tabs 94. The cooperation of tabs 94 with embossments 93 and 97 is more fully described hereinafter.

Figure 4:
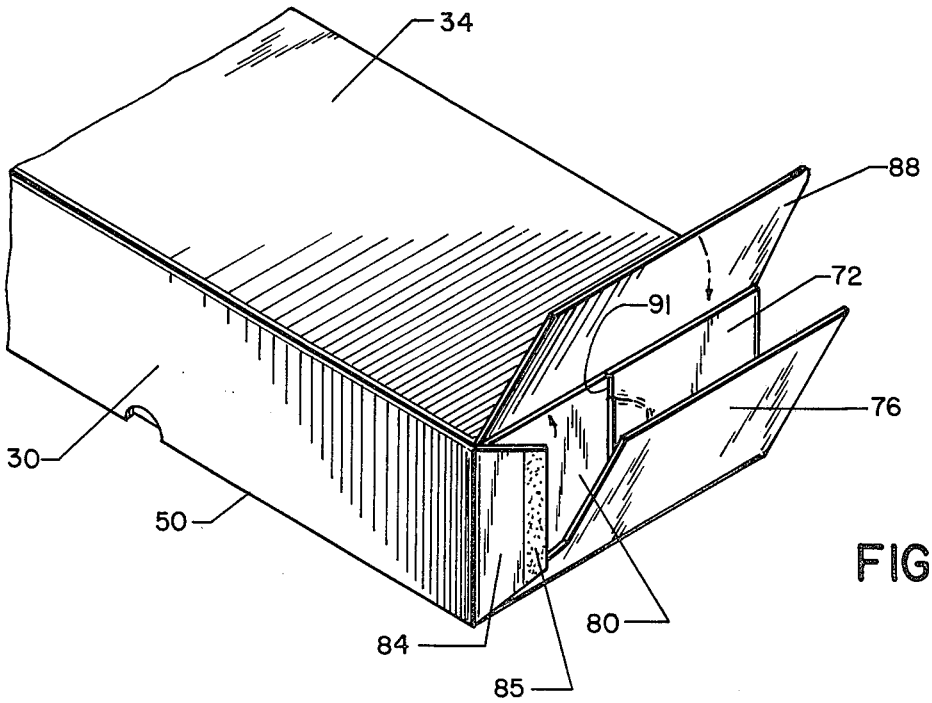
Figure 5:
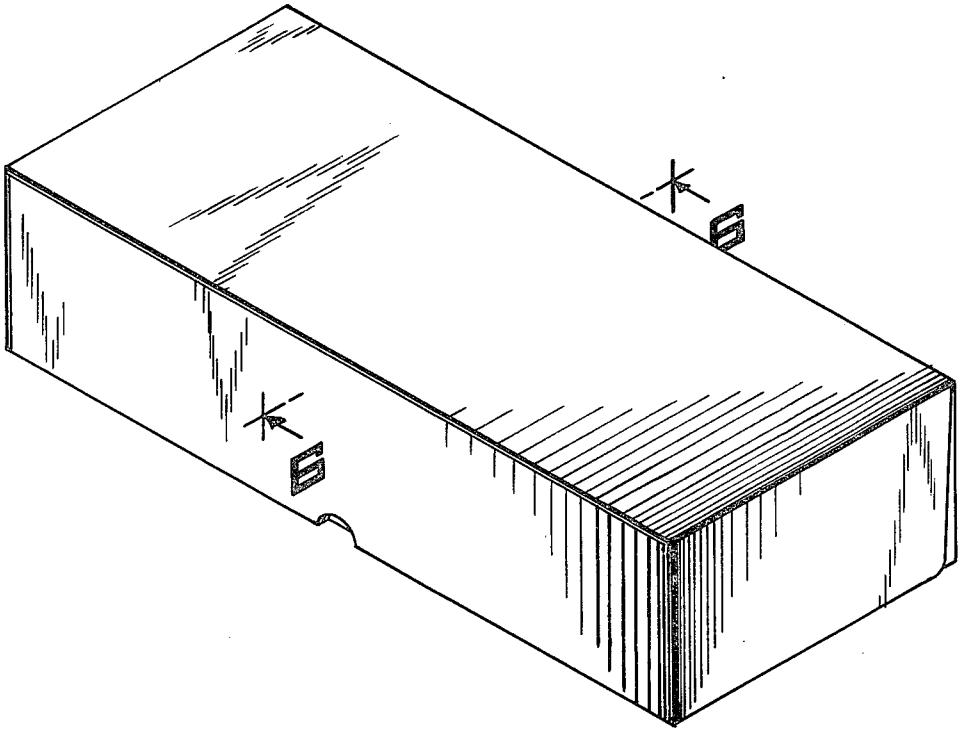
FIG. 5 is a perspective view of the carton fully closed.

Adhesive patterns are shown at 89 on panel 26 and 87 on panel 38 and flaps 72. Adhesive is additionally applied at 99 to flaps 76, as shown in FIG. 1, and to the bottom side of flaps 84 as at 85 in FIG. 4.

Hole 83 is located at the approximate mid-point of hinge line 50 and serves as a convenient location for grasping the lower edge of the front wall when opening the carton.

One skilled in the art will appreciate that terminology regarding a carton blank is somewhat different from the terminology regarding the set up carton. Thus, the blank is described as having panels and flaps as its main members. The carton is herein described as having walls, the walls being composed of one or more panels and/or flaps. It follows, then, that a panel in the carton blank may be described as a wall in the carton. In the illustrated embodiment of the carton, the top and bottom walls are composed of single panels. The front and rear walls are composed of multiple panels. The side walls are composed of multiple flaps. Similarly, panels and flaps may be combined in forming carton walls. Thus is the recitation, for example of "top wall panel 34" in the carton blank consistent with the recitation of "top wall 34" in the carton.

Figure 2:
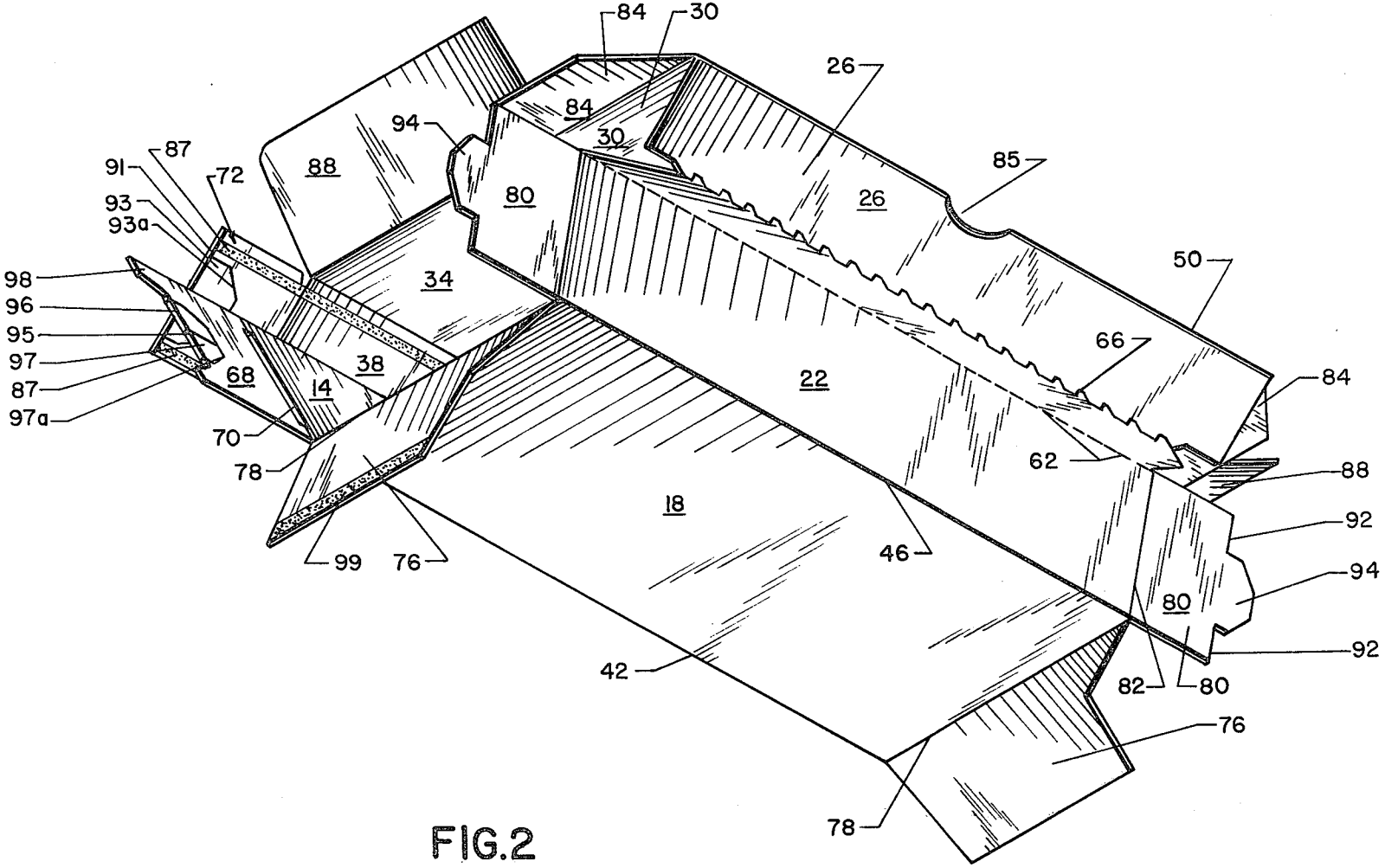
FIG. 2 shows a carton partially, and artificially, folded to indicate the structure of the front and rear walls.

In gluing the carton, panel 14 is first folded about line 42 onto panel 18. Panels 30, 34, and 38 are then folded about line 50, and onto panels 14, 18, 22 and 26. Finally, panels 26 and 30 are folded about hinge lines 62 and 54 onto panel 22. FIG. 2 indicates, in three dimensions, the relationships of the various carton components resulting from the above recited sequences, while artificially holding the components apart for ease of viewing. In reality, at this stage, the adhesive 87 on panel 38 is adhered to panel 14 and the adhesive on panel 26 is adhered to panel 30; thus forming panels 26 and 30 into the front skirt, and forming panels 14 and 38 into the rear wall. Similarly, the adhesive 87 on flaps 72 adheres flaps 72 to the corresponding flaps 68.

The carton is then set up into tubular form by pushing hinge lines 42 and 54 toward each other. The carton may then be filled with product and the sides closed. For purposes of illustration, FIG. 3 shows the carton empty when the side is being closed.

Figure 3:
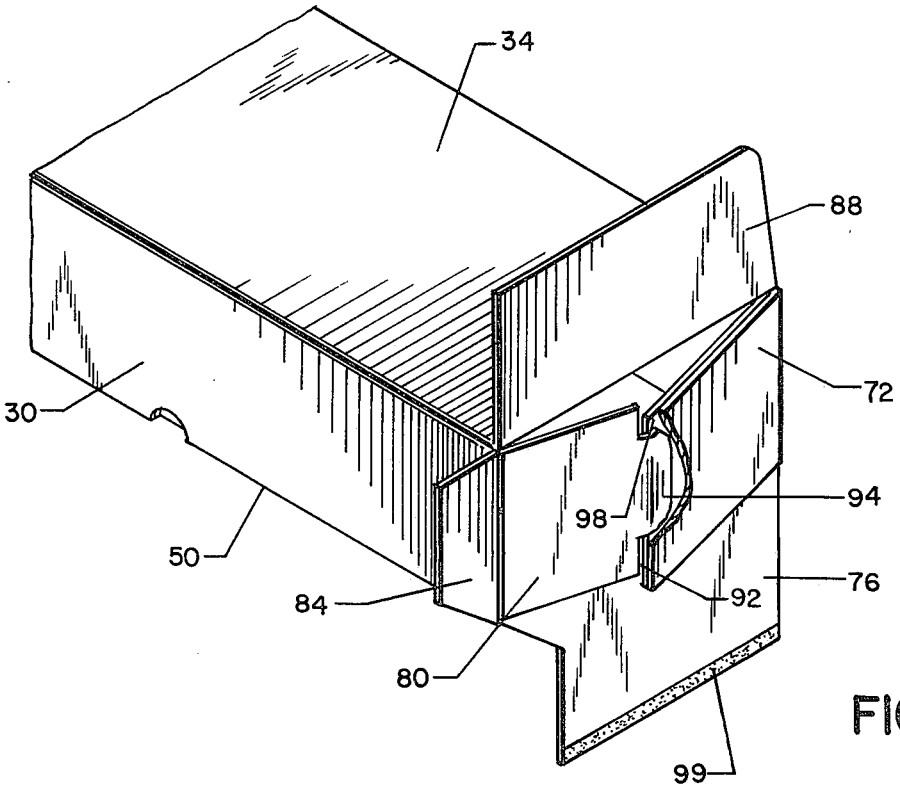
FIGS. 3 and 4 are perspective views of the tubular carton side-seam glued and set up, and showing the structure of a side wall, and its sequence of closure.

First, the front and rear side flaps are brought together as shown in FIG. 3. Tab 94 is inserted into the space created by the spaced embossments 93 and 97 on underlying rear inner side flap 68 and overlying rear outer side flap 72. See also FIGS. 7 and 8. The facing surfaces of flaps 68 and 72, except for embossments 93 and 97, are held in substantially face to face contact by adhesive 87. Cut line 95 provides additional resilience to embossment 97, allowing it to flex and temporarily increase the space between portions of embossments 95 and 97 on insertion of tab 94. Shoulders 98 extend past the rear edge 92 of flaps 80 and are positioned adjacent the outside surface of flaps 80. With tab 94 fully seated in the space beween flaps 68 and 72, the side of the carton appears as in FIG. 4. Bottom side flaps 76 are then folded up about lines 78 and adhered to flaps 72 and 80. Tabs 84 are folded back against flaps 80, and side skirts 88 are folded down against tabs 84 and flaps 76; adhering skirts 88 to tabs 84.

The thus completed carton appears as in FIGS. 5–8. These figures reveal that the front, rear, and right and left side walls, of the completed carton all have multiple thicknesses of carton material, for substantially the full height of the carton, which gives the carton an excellent capability to withstand crushing. Concurrently, the top and bottom walls have only a single thickness of carton material for purposes of economy and conservation. See FIG. 6.

Figure 6:
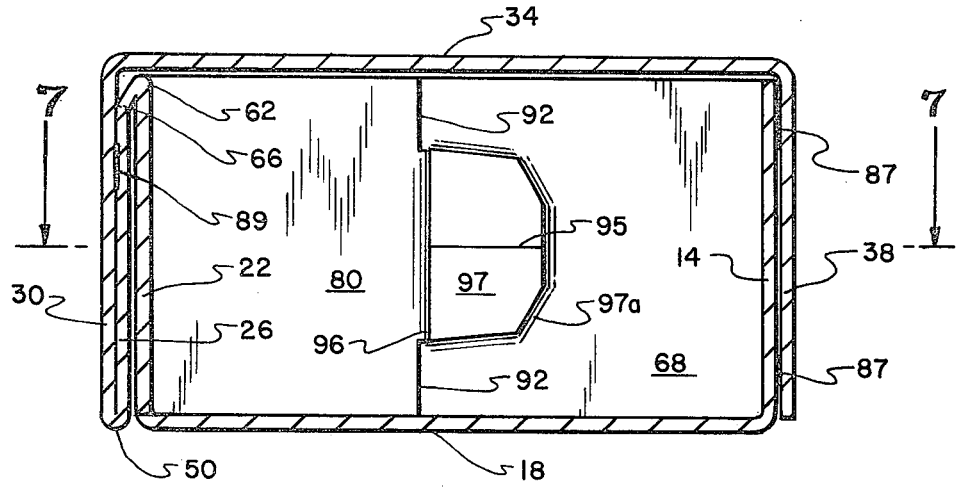
FIG. 6 is a vertical cross-section of the carton taken at 6—6 of FIG. 5.
Figure 7:
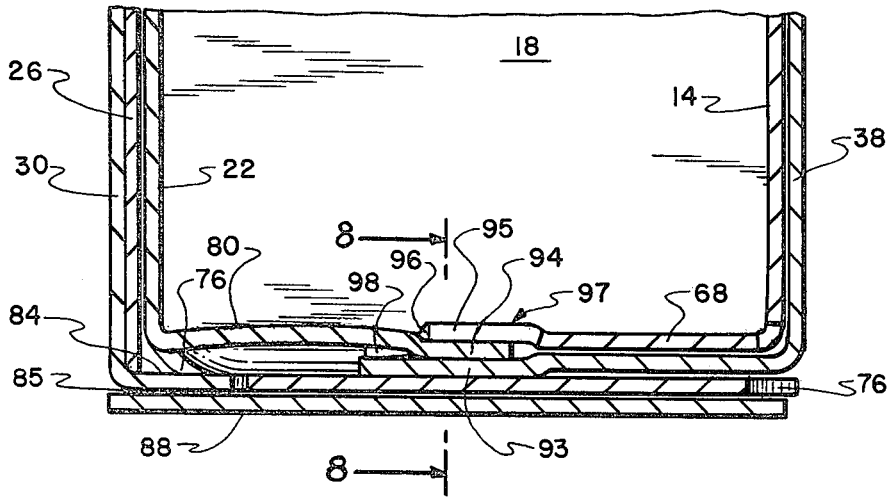
FIG. 7 is a fragmentary horizontal cross-section of a side wall taken at 7—7 of FIG. 6.
Figure 8:
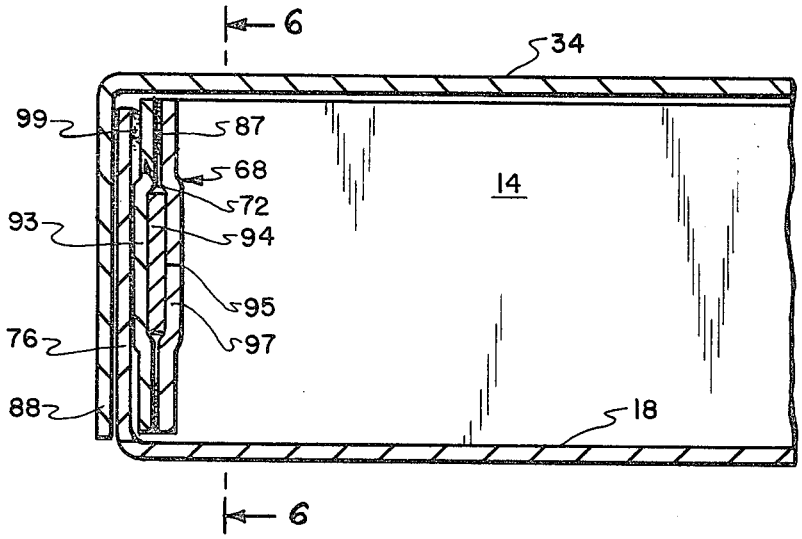
FIG. 8 is a fragmentary vertical cross-section of a side wall taken at 8—8 of FIG. 7.

FIGS. 6, 7 and 8 show in detail the locations of the various elements of the carton side wall. Further, the combination of the size and locations of the various side flaps, along with their adhesive connections, make the side walls highly contributory to the overall rigidity of the package; such that, in addition to its crush resistance, this side loaded carton has a surprising resistance to bending and twisting stresses.

Figure 9:
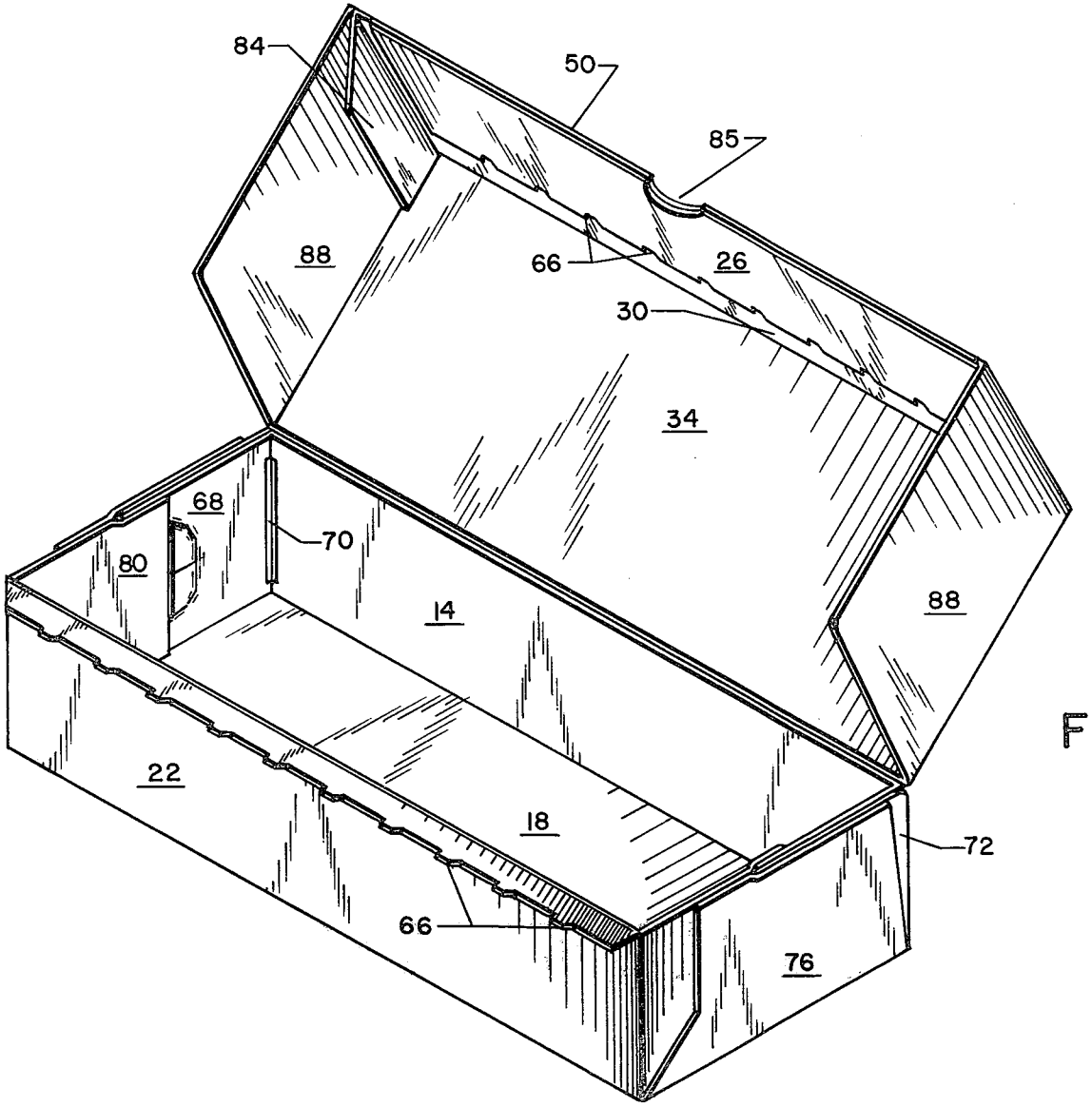
FIG. 9 is a perspective view of the opened carton.

The carton is opened by raising the top of the carton, along with the front and side skirts, and breaking line of weakness 66. The opened carton is shown in FIG. 9. The carton may be repeatedly opened and reclosed, with latching, as is customary for flip top style cartons.

Accordingly, line of weakness 66 should be weaker than dashed cut line 62, in order that the break will occur at 66. Conversely, if 62 is the weaker line, the break will occur there, and the latching feature on reclosure is sacrificed. Both constructions are contemplated by the invention. In a combination construction, lines 62 and 66 are merged into one line of weakness at 62. Similarly, line 62 may be formed by a crease score when separate lines 62 and 66 are provided.

Line of weakness 66 may be located, by appropriate adaptation on any of panels 22, 26 and 30. The line of weakness would still extend across the front wall, but need not extend onto depending flaps. Moreover, if the line of weakness does extend onto depending flaps, one skilled in the art can ensure that adhesive on the subject flaps does not preclude opening of the package.

For example, the line of weakness could extend across panel 22, between lines 46 and 62 and terminate, by means of angular connecting lines, at the intersections of lines 82 and 62. However, it is important to note that the area of adhesion provided in the set-up carton, such as that provided by 89 in FIG. 1, is between the hinge line 50 and the line of weakness which breaks when the carton is opened. This property is observed by traversing the vertical cross-section of the front wall, as, for example, in FIG. 6, from the line of weakness 66 along the line of material exposed by the cutting away, to hinge line 50. Observing this property ensures that the breaking of the line of weakness is effective to separate the front wall into a receptable portion and a cover portion. While this general description is effective in forming the carton structure, the flip-top reclosure feature is most easily employed when the line of weakness is on panel 26 as shown.

The invention having been described in terms of the illustrated embodiment, it is intended that the property right be limited only by the scope of the appended claims.

Having thus described the invention, what is claimed is:

1. A carton comprising: a bottom wall; an upstanding front wall connected to the front edge of said bottom wall; an upstanding rear wall connected to the rear edge of said bottom wall; a top wall connected to one of said front and rear walls; and right and left side walls; each said side wall having a front side flap connected to, and projecting rearwardly from, said front wall, and having a male locking tab projecting rearwardly from its rear edge; each said side wall also having a pair of inner and outer rear side flaps connected to, and projecting frontwardly from, said rear wall; said rear side flaps being secured to each other in face to face relationship; said inner rear side flap having a first front edge substantially coincident with said rear edge of said front side flap, said outer rear side flap having a second front edge located frontwardly of said first front edge; each said side wall also having a bottom securing flap hingedly attached to each side edge of said bottom wall, said bottom securing flaps overlying, and being secured to, corresponding ones of both said outer rear side flaps and said front side flaps.

2. A carton as in claim 1, each said inner rear side flap having a pair of shoulders projecting frontwardly from said front edge on the top and bottom thereof.

3. A carton as in claim 2, each said inner rear side flap further comprising an inward embossment extending rearwardly from said front edge and corresponding in shape with, and underlying, said male locking tab.

4. A carton as in claim 3, each said inner rear side flap further comprising a cut line extending rearwardly from the front edge of said inner rear side flap across said embossment.

5. A side loading, top opening carton having reinforced stacking strength in its front, rear and side walls, and being formed from a one-piece blank, said carton comprising: opposing front and rear walls, and left and right side walls, a bottom wall hingedly attached to said front and rear walls, and a top wall hingedly attached to said rear wall, said front wall comprising an inner front wall panel, and an outer skirt connected to the front edge of said top wall, said outer skirt comprising an outer skirt panel having said connection to said top wall, and projecting downwardly substantially the entire height of said carton, from top to bottom thereof, and an inner skirt panel connected to the bottom of said outer skirt panel at a predetermined fold line, and to the top of said inner front wall panel; said front wall having a line of weakness extending from one said side edge to the other said side edge; said inner and outer front skirt panels being affixed to each other between said line of weakness and said predetermined fold line; said rear wall comprising a first panel hingedly attached to said top wall and extending downwardly substantially the entire height of said rear wall, and a second panel attached to said first panel and hingedly attached to said bottom wall and extending upwardly substantially the entire height of said rear wall, each said side wall having a front side flap connected to, and projecting rearwardly from, said front wall, and having a male locking tab projecting rearwardly from its rear edge; each said side wall having a pair of inner and outer rear side flaps connected to, and projecting frontwardly from said rear wall, said rear side flaps being secured to each other in face to face relationship; said inner rear side flap having a first front edge substantially coincident with said rear edge of said front side flap; said outer rear side flap having a second front edge located frontwardly of said first front edge; each said side wall also having a bottom securing flap hingedly attached to each side edge of said bottom wall, said bottom securing flaps overlying, and being secured to, corresponding ones of both said outer rear side flaps and said front side flaps.

6. A carton as in claim 5, each said inner rear side flap having a pair of shoulders projecting frontwardly from said front edge on the top and bottom thereof.

7. A carton as in claim 6, each said inner rear side flap further comprising an inward embossment extending rearwardly from said front edge and corresponding in shape with, and underlying, said male locking tab.

8. A carton as in claim 7, each said inner rear side flap further comprising a cut line extending rearwardly from the front edge of said inner rear side flap across said embossment.

9. A carton as in claim 1, 4, 5, or 8, each said outer rear side flap having an outward embossment corresponding substantially in shape to, and overlying, said male locking tab.

* * * * *